US010704479B2

(12) United States Patent
Oh et al.

(10) Patent No.: US 10,704,479 B2
(45) Date of Patent: Jul. 7, 2020

(54) ACTIVE FUEL VAPOR PURGING SYSTEM AND METHOD USING THE SAME

(71) Applicants: HYUNDAI MOTOR COMPANY, Seoul (KR); KIA MOTORS CORPORATION, Seoul (KR)

(72) Inventors: Young Kyu Oh, Gwacheon-Si (KR); Jeong Ho Seo, Seoul (KR); Yong Seok Kim, Seoul (KR); Yeong Jin Nam, Ansan-Si (KR); Taeho Ahn, Incheon (KR); Sung Wook Park, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 66 days.

(21) Appl. No.: 16/195,344

(22) Filed: Nov. 19, 2018

(65) Prior Publication Data

US 2019/0186393 A1 Jun. 20, 2019

(30) Foreign Application Priority Data

Dec. 18, 2017 (KR) ..... 10-2017-0174095

(51) Int. Cl.
*F02D 41/00* (2006.01)
*F02M 25/08* (2006.01)
*F02M 35/10* (2006.01)

(52) U.S. Cl.
CPC ..... *F02D 41/0045* (2013.01); *F02M 25/089* (2013.01); *F02M 35/10006* (2013.01);
(Continued)

(58) Field of Classification Search
CPC ..... F02D 41/004; F02D 41/0045; F02M 25/0836; F02M 25/0872; F02M 25/089
See application file for complete search history.

(56) References Cited

U.S. PATENT DOCUMENTS 9,587,595 B2 * 3/2017 Woods ..... F02M 25/089
9,689,351 B2 * 6/2017 Ono ..... F02M 25/0836
(Continued)

FOREIGN PATENT DOCUMENTS

JP 2017-106368 A 6/2017
KR 10-2016-0045598 A 4/2016

*Primary Examiner* — Hung Q Nguyen
*Assistant Examiner* — Anthony L Bacon
(74) *Attorney, Agent, or Firm* — Morgan, Lewis & Bockius LLP

(57) ABSTRACT

An active fuel vapor purge system includes: a turbocharger having a turbine and a compressor; a canister collecting fuel vapor; a purge pump pumping the collected fuel vapor; a main purge line connecting the canister and the purge pump; a first purge line branched from the main purge line and joined to an intake manifold at downstream of the compressor; a second purge line branched from the main purge line and jointed to an intake line at upstream of the compressor; purge control solenoid valves respectively disposed in the first purge line and the second purge line; a hydrocarbon sensor measuring an amount of hydrocarbon; a pressure sensor measuring an upstream pressure and a downstream pressure of the purge pump; and a controller controlling operation of the purge pump based on the amount of hydrocarbon and pressures at a front end and at a rear end of the purge pump.

8 Claims, 3 Drawing Sheets

(52) U.S. Cl.
CPC ..... *F02M 35/10157* (2013.01); *F02M 35/10222* (2013.01); *F02D 2200/06* (2013.01); *F02D 2200/0602* (2013.01)

(56) References Cited

U.S. PATENT DOCUMENTS

| | | | | |
|---|---|---|---|---|
| 2011/0307157 | A1* | 12/2011 | Pursifull | F02D 41/0007 701/102 |
| 2014/0096749 | A1* | 4/2014 | Pearce | F02D 41/004 123/520 |
| 2015/0159597 | A1 | 6/2015 | Woods et al. | |
| 2015/0285170 | A1* | 10/2015 | Nanba | F02D 41/004 123/520 |
| 2015/0292421 | A1* | 10/2015 | Pursifull | F02D 41/004 123/518 |
| 2016/0123280 | A1* | 5/2016 | Makino | F02M 25/089 123/519 |
| 2016/0201613 | A1* | 7/2016 | Ulrey | F02M 25/0836 123/520 |
| 2016/0290285 | A1* | 10/2016 | Dudar | F02M 25/089 |
| 2018/0058385 | A1* | 3/2018 | Choi | F02M 25/0872 |
| 2018/0080416 | A1* | 3/2018 | Choi | F02D 41/0032 |
| 2018/0135565 | A1* | 5/2018 | Choi | F02D 41/0032 |
| 2018/0187614 | A1* | 7/2018 | Dudar | F02D 41/004 |
| 2018/0347511 | A1* | 12/2018 | Makino | F04D 23/008 |
| 2019/0271284 | A1* | 9/2019 | Sugiura | F02M 25/089 |

* cited by examiner

ACTIVE FUEL VAPOR PURGING SYSTEM AND METHOD USING THE SAME

CROSS-REFERENCE TO RELATED APPLICATION

This application claims priority to and the benefit of Korean Patent Application No. 10-2017-0174095 filed in the Korean Intellectual Property Office on Dec. 18, 2017, the entire contents of which are incorporated herein by reference.

TECHNICAL FIELD

The present disclosure relates to an active fuel vapor purge system and a control method using the same.

BACKGROUND

In the automotive industry, there has been ongoing research on improvement of emissions. For minimizing hydrocarbons (HO) in evaporation gas of gasoline fuel, emissions from fuel evaporation have been reduced to under 0.5 g/day in some countries, and it will be further limited to under 0.054 g/day by law.

Improvements in fuel tank materials and optimizing connection structures have been further studied in order to minimize generation of fuel evaporation gas that permeate from the fuel tank, and a fuel vapor recirculation device provided with a canister has also been used.

The canister contains an absorbent material such as activated carbon for absorbing the fuel vapor or fuel evaporation gas from the fuel tank, or a float chamber for preventing discharge of the fuel vapor or fuel evaporation gas to the atmosphere.

The absorbed fuel vapor can be transmitted to an engine for combustion through a pressure control solenoid valve (Purge Control Solenoid Valve; PCSV) that is controlled by an engine control unit (ECU).

The fuel vapor purge system supplies fuel vapor collected in the canister to an intake manifold or an intake line at a front end of a compressor of a turbocharger by using a positive pressure and a negative pressure formed in the intake manifold, and then the fuel vapor is supplied to a combustion chamber of the engine.

However, in case of a hybrid vehicle which has been recently researched and developed, a negative pressure is frequently not generated in the intake manifold. For example, in case of a hybrid vehicle, the vehicle is driven by operation of a motor in many cases, and when an idle stop-and-go (ISG) system is installed, the operation of the engine is periodically stopped. Further, when a turbocharger operates, fuel vapor cannot be purged often due to an excessive pressure supplied to the intake manifold.

As described, since the negative pressure is not frequently generated in the intake manifold in case of the hybrid vehicle which has been recently researched and developed, a problem that it cannot cope with the regulations of the fuel vapor evaporated in a fuel tank arises.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide an active fuel vapor purge system that can supply fuel vapor evaporated from a fuel tank to a combustion chamber of an engine, and a method for controlling the same in a case like a hybrid vehicle in which a negative pressure is not frequently generated in an intake manifold.

An active fuel vapor purge system according to an exemplary embodiment of the present disclosure includes: a turbocharger that includes a turbine disposed in an exhaust line through which an exhaust gas discharged from an engine flows, and a compressor that rotates in conjunction with the turbine and compresses an intake gas supplied to the engine; a canister that collects fuel vapor evaporated in a fuel tank; a purge pump that pumps the fuel vapor collected in the canister; a main purge line that connects the canister and the purge pump; a first purge line that is branched from the main purge line and joined to an intake manifold at downstream of the compressor; a second purge line that is branched from the main purge line and joined to an intake line at upstream of the compressor; purge control solenoid valves that are respectively disposed in the first purge line and the second purge line and block fuel vapor collected in the canister; a hydrocarbon sensor that is disposed in the main purge line and measures an amount of hydrocarbon collected in the canister; a pressure sensor that measures an upstream pressure and a downstream pressure of the purge pump; and a controller that controls operation of the purge pump based on the amount of hydrocarbon and a pressure at a front end and a pressure at a rear end of the purge pump.

The controller may drive the purge pump when the amount of hydrocarbon measured by the hydrocarbon sensor is greater than a predetermined amount.

The controller may control speed of the purge pump in a stepwise fashion when a pressure difference between the front end and the rear end of the purge pump, measured by the pressure sensor is greater than a predetermined differential pressure.

The controller may increase the speed of the purge pump in a stepwise fashion when the pressure difference between the front end and the rear end of the purge pump, measured by the pressure sensor, is increased.

According to another exemplary embodiment of the present disclosure, a method for controlling a fuel purge system that pumps fuel vapor collected in a canister by using a purge pump and supplies the fuel vapor to an intake manifold and an intake line at a front end of a compressor includes: determining, by a controller, whether an amount of hydrocarbon in the canister, measured by a hydrocarbon sensor, is greater than a predetermined amount; determining, by the controller, whether a pressure difference between a front end and a rear end of the purge pump, measured by a pressure sensor, is greater than a predetermined differential pressure; and controlling, by the controller, operation of the purge pump based on the amount of hydrocarbon and the pressure difference between the front end and the rear end of the purge pump.

In the controlling of the operation of the purge pump, when the amount of hydrocarbon in the canister is greater than the predetermined amount, the purge pump may be controlled to operate.

When the pressure difference between the front end and the rear end of the purge pump, measured by the pressure sensor, is greater than the predetermined differential pressure, speed of the purge pump may be controlled in a stepwise fashion.

The speed of the purge pump may be increased in a stepwise fashion when the pressure difference between the front end and the rear end of the purge pump, measured by the pressure sensor, is increased.

According to the active fuel vapor purge system according to the above-described exemplary embodiment of the present disclosure, operation of the purge pump can be controlled according to the amount of hydrocarbon in the canister and a pressure difference between the front end the rear end of the purge pump, and accordingly, fuel vapor evaporated from the fuel tank can be supplied to the combustion chamber of the engine.

BRIEF DESCRIPTION OF THE DRAWINGS

Reference is made to the following drawings in order to describe exemplary embodiments of the present disclosure, and thus the technical spirit of the present disclosure should not be construed as being limited to the accompanying drawings.

DETAILED DESCRIPTION OF THE EMBODIMENTS

Figure 1:
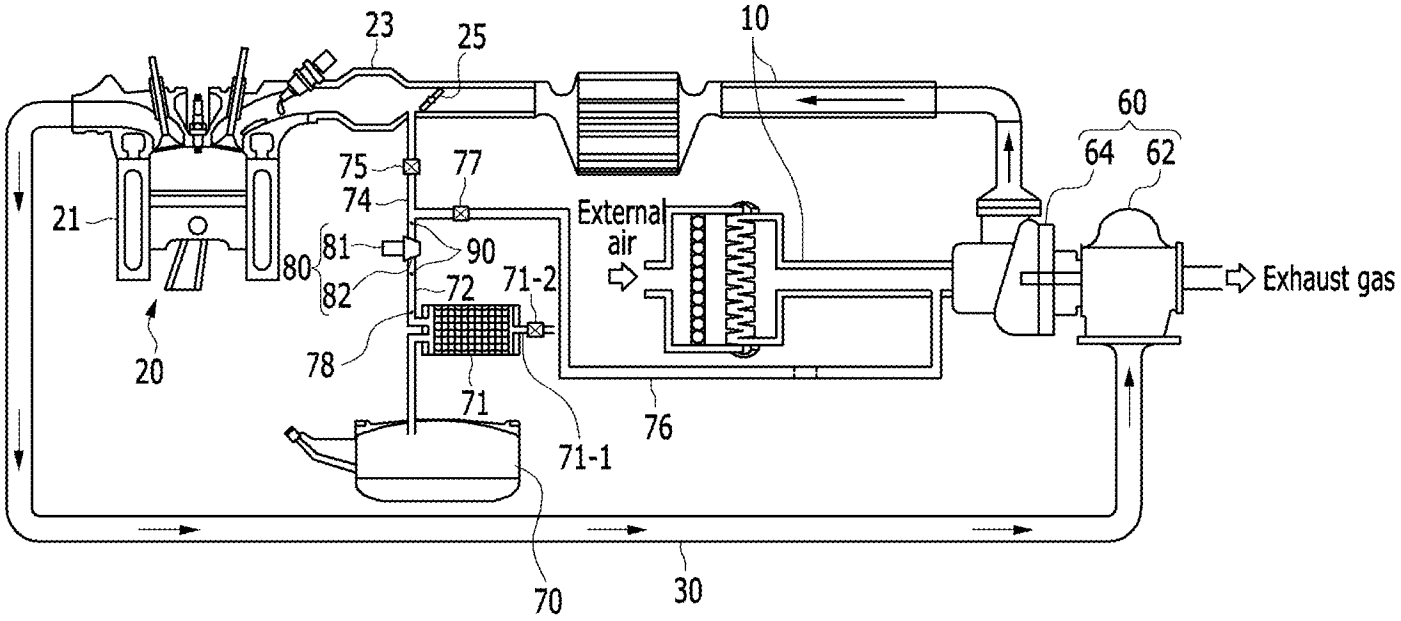
FIG. 1 is a schematic view of an active fuel vapor purge system according to an exemplary embodiment of the present disclosure.

The present disclosure will be described more fully hereinafter with reference to the accompanying drawings, in which exemplary embodiments of the invention are shown. As those skilled in the art would realize, the described embodiments may be modified in various different ways, all without departing from the spirit or scope of the present disclosure.

The drawings and description are to be regarded as illustrative in nature and not restrictive. Like reference numerals designate like elements throughout the specification.

Since the size and the thickness of each configuration shown in drawings are arbitrarily indicated for better understanding and ease of description, the present disclosure is not limited to shown drawings, and the thickness of layers, films, panels, regions, etc., are exaggerated for clarity.

Hereinafter, an active fuel vapor purge system according to an exemplary embodiment of the present disclosure will be described in detail with reference to the accompanying drawings.

Figure 2:
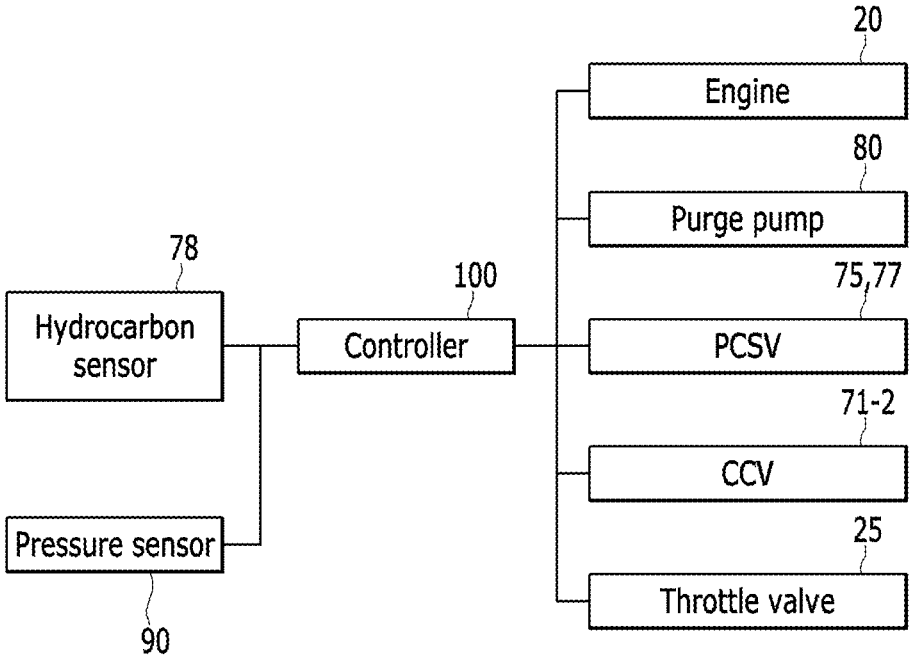
FIG. 2 is a block diagram of the active fuel purge system according to the exemplary embodiment of the present disclosure.

FIG. 1 is a schematic view of an active fuel vapor purge system according to an exemplary embodiment of the present disclosure, and FIG. 2 is a block diagram of a configuration of the active fuel vapor purge system according to the exemplary embodiment of the present disclosure.

As shown in FIG. 1 and FIG. 2, an active fuel vapor purge system according to an exemplary embodiment of the present disclosure includes an engine 20 and a turbocharger 60.

The engine 20 includes a plurality of cylinders 21 that generate driving torque from combustion of fuel. The engine 20 is provided with an intake line 10 through which an intake gas supplied to the cylinder 21 flows and an exhaust line 30 through which an exhaust gas exhausted from the cylinder 21 flows.

Air taken in through the intake line 10 is supplied to the cylinder 21 through an intake manifold 23. A throttle valve 25 is provided to control the amount of air taken into the cylinder 21 in the intake line 10 upstream of the intake manifold 23.

The turbocharger 60 compresses and supplies an intake gas (external air and recirculated gas) to the cylinder 21 by operation of exhaust gas exhausted from the cylinder 21 through the exhaust line 30 and through the intake line 10. The turbocharger 60 includes a turbine 62 that is provided in the exhaust line 30 and rotates by exhaust gas exhausted from the cylinder 21, and a compressor 64 that rotates in conjunction with the turbine 62 and compresses the exhaust gas.

A volatile fuel supplied to the cylinder 21 is stored in a fuel tank 70, and a canister 71 is connected with the fuel tank 70 through a vapor line and contains an absorbent material that can absorb fuel vapor. That is, the fuel vapor that is evaporated from the fuel tank 70 is collected through the canister 71.

The canister 71 is connected with an air passage 71-1, and a canister close valve (CCV) 71-2 is installed in the air passage 71-1. Opening and closing of the canister close valve 71-2 is controlled by a controller, which will be described later. External air is selectively supplied to the canister 71 by opening and closing of the canister close valve 71-2.

The fuel vapor collected in the canister 71 is compressed and transfer through a purge pump 80 and then supplied to the intake manifold 23 (or the intake line 10 upstream of the compressor 64). For this, the purge pump 80 may include a motor 81 and an impeller 82 that rotates by power of the motor 81. Speed of the purge pump 80 is controlled by controlling rotational speed of the motor 81. The motor 81 operates by a control signal of a controller 100.

The canister 71 is connected with the intake manifold 23 and the intake line 10 upstream of the compressor 64 through purge lines. The fuel vapor flows through the purge lines. The purge lines are formed of a main purge line 72 that connects the canister 71 and the purge pump 80, a first purge line 74 that is branched from the main purge line and joined to the intake manifold 23, and a second purge line 76 that is branched from the main purge line 72 and joined to the intake line 10 upstream of the compressor 64.

The first purge line 74 and the second purge line 76 are respectively provided with purge control solenoid valves (PCSV) 75 and 77. The purge control solenoid valves 75 and 77 selectively block the fuel vapor collected in the canister 71. The purge control solenoid valves 75 and 77 are controlled by the controller.

A hydrocarbon (HC) sensor 78 is provided in the main purge line that is provided between the canister 71 and the purge pump 80. The HC sensor 78 measures an amount of hydrocarbon included in the fuel vapor collected in the canister 71, and the measured amount of hydrocarbon is transmitted to the controller.

Pressure sensors 90 are provided at a front end and a rear end of the purge pump 80. The pressure sensors 90 measure pressures at the front end and the rear end of the purge pump 80, and a differential pressure between the measured pressures of the front end and the rear end of the purge pump 80 is transmitted to the controller 100.

The controller 100 may be an engine control unit (ECU) provided in a vehicle. The controller 100 controls operations of the engine 20, the turbocharger 60, the canister close valve 71-2, the purge control solenoid valve 73, and the purge pump 80.

Thus, the controller 100 may include at least one processor which is operated by a preset program, and the predetermined program performs respective steps of the method for controlling the active fuel vapor purge system according to an exemplary embodiment of the present disclosure.

Hereinafter, a method for controlling the fuel vapor purge system according to an exemplary embodiment of the present disclosure will be described in detail with reference to the accompanying drawings.

Figure 3:
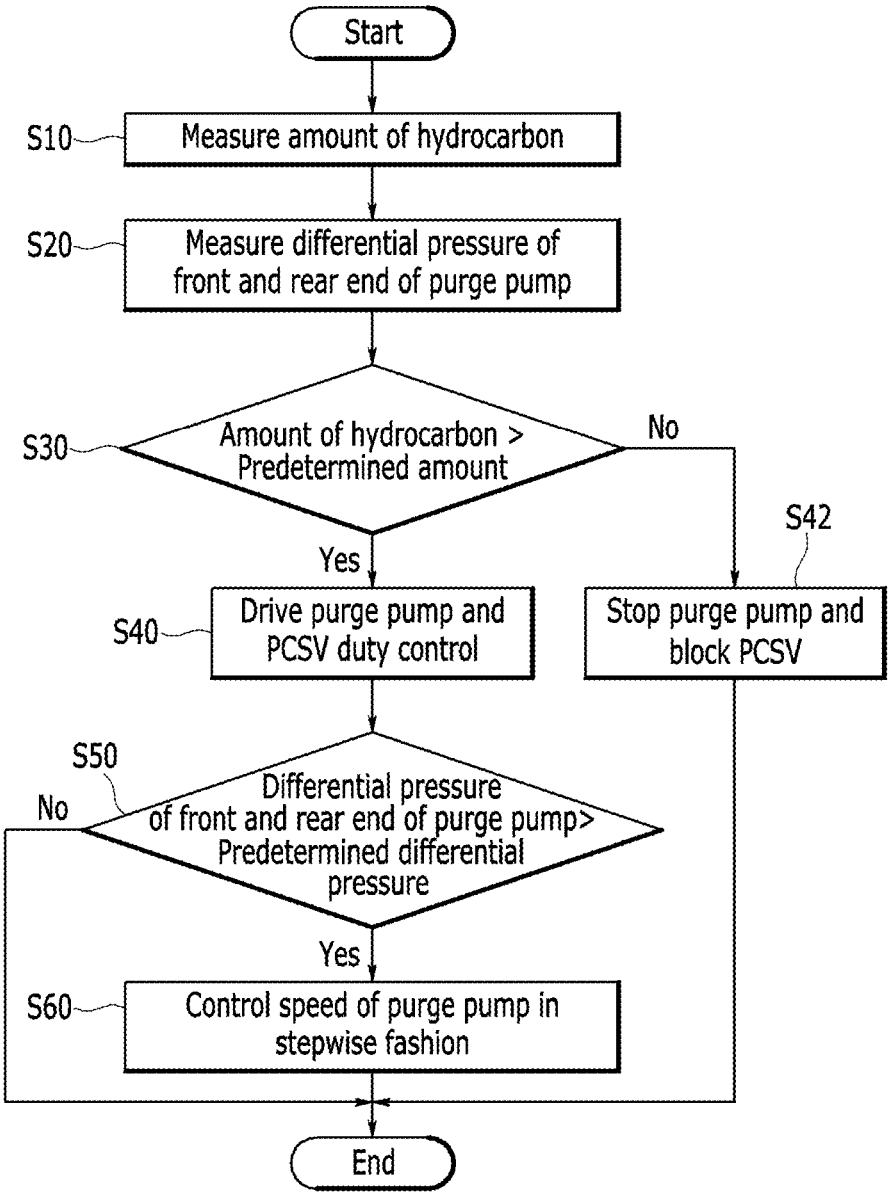
FIG. 3 is a flowchart of a control method of the active fuel purge system according to an exemplary embodiment of the present disclosure.

FIG. 3 is a flowchart of a control method of the active fuel vapor purge system according to an exemplary embodiment of the present disclosure.

As shown in FIG. 3, the HC sensor 78 measures an amount of hydrocarbon collected in the canister 71 (S10). The amount of hydrocarbon measured by the HO sensor 78 is transmitted to the controller 100.

The pressure sensors 90 measure pressures at front and rear ends of the purge pump 80 (S20), and a differential pressure between the front end and the rear end of the purge pump 80 measured by the pressure sensor 90 is transmitted to the controller 10.

The controller 100 determines whether the amount of hydrocarbon measured by the HO sensor 78 is greater than a predetermined amount (S30).

When the amount of hydrocarbon included in the fuel vapor collected in the canister 71 is less than the predetermined amount, the controller 10 does not operate the purge pump 80 and blocks the purge control solenoid valves 75 and 77 (S42).

When the amount of hydrocarbon collected in the canister 71 is greater than the predetermined amount, the controller 100 operates the purge pump 80, performs duty controls of the purge control solenoid valves 75 and 77, and controls a fuel vapor amount discharged from the canister 71 (S40). In this case, depending on a driving region of the engine 20, either the first purge control solenoid valve 75 or the second purge control solenoid valve 77 is controlled. When the first purge control solenoid valve 75 is controlled to be opened, the fuel vapor is supplied to the intake manifold 23, and when the second purge control solenoid valve 77 is controlled to be opened, the fuel vapor is supplied to the intake line 10 upstream of the compressor 64.

The controller 100 determines whether a pressure difference between the front end and the rear end of the purge pump 80 measured by the pressure sensor 90 is greater than a predetermined differential pressure (S50).

When the pressure difference between the front end and the rear end of the purge pump 80 measured by the pressure sensor 90 is greater than the predetermined differential pressure, the controller 100 controls the speed of the purge pump 80 in a stepwise fashion (S60). In this case, the controller 100 controls the speed of the purge pump 80 to be increased in a stepwise fashion as the pressure difference between the front end and the rear end of the purge pump 80 is increased.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An active fuel vapor purge system comprising:

a turbocharger that includes:

a turbine disposed on an exhaust line through which an exhaust gas discharged from an engine flows; and a compressor rotating in conjunction with the turbine and compressing an intake gas supplied to the engine;

a canister that collects fuel vapor evaporated in a fuel tank;

a purge pump that pumps the fuel vapor collected in the canister;

a main purge line that connects the canister and the purge pump;

a first purge line that is branched from the main purge line and joined to an intake manifold at downstream of the compressor;

a second purge line that is branched from the main purge line and jointed to an intake line at upstream of the compressor;

purge control solenoid valves that are respectively disposed in the first purge line and the second purge line and block fuel vapor collected in the canister;

a hydrocarbon sensor that is disposed in the main purge line and measures an amount of hydrocarbon collected in the canister;

a pressure sensor that measures an upstream pressure and a downstream pressure of the purge pump; and a controller that controls operation of the purge pump based on the amount of hydrocarbon measured by the hydrocarbon sensor, and further based on a pressure at a front end and a pressure at a rear end of the purge pump, each of which is measured by the pressure sensor.

2. The active fuel vapor purge system of claim 1, wherein the controller drives the purge pump when the amount of hydrocarbon is greater than a predetermined amount.

3. The active fuel vapor purge system of claim 2, wherein the controller increases speed of the purge pump manner when a pressure difference between the front end and the rear end of the purge pump is greater than a predetermined differential pressure.

4. The active fuel vapor purge system of claim 3, wherein the controller increases the speed of the purge pump in the stepwise manner when the pressure difference between the front end and the rear end of the purge pump increases.

5. A method for controlling a fuel vapor purge system that pumps fuel vapor collected in a canister by using a purge pump and supplies the fuel vapor to an intake manifold and an intake line at a front end of a compressor, the method comprising steps of:

determining, by a controller, whether an amount of hydrocarbon in the canister, measured by a hydrocarbon sensor, is greater than a predetermined amount;

determining, by the controller, whether a pressure difference between a front end and a rear end of the purge pump, measured by a pressure sensor, is greater than a predetermined differential pressure; and controlling, by the controller, operation of the purge pump based on the amount of hydrocarbon and the pressure difference between the front end and the rear end of the purge pump.

6. The method of claim 5, wherein, in the step of controlling the operation of the purge pump, when the amount of hydrocarbon in the canister is greater than the predetermined amount, the controller controls the purge pump to operate.

7. The method of claim 6, wherein, when the pressure difference between the front end and the rear end of the purge pump is greater than the predetermined differential pressure, speed of the purge pump is controlled in a stepwise manner.

8. The method of claim 7, wherein the speed of the purge pump increases in the stepwise manner when the pressure difference between the front end and the rear end of the purge pump increases.

* * * * *